United States Patent [19]

Guenard

[11] 4,263,566

[45] Apr. 21, 1981

[54] BACKWARD WAVE OSCILLATOR TUBE UTILIZING SUCCESSIVE DELAY LINE SECTIONS FOR INCREASED POWER

[75] Inventor: Pierre Guenard, Paris, France

[73] Assignee: Thomson-CSF, Paris, France

[21] Appl. No.: 28,548

[22] Filed: Apr. 9, 1979

[30] Foreign Application Priority Data

Apr. 11, 1978 [FR] France ..... 78 10615

[51] Int. Cl.[3] ..... H01J 25/40

[52] U.S. Cl. ..... 331/82; 315/3.5; 315/3.6; 315/39.3

[58] Field of Search ..... 331/79, 81, 82; 315/3.5, 3.6, 39.3; 330/43

[56] References Cited

U.S. PATENT DOCUMENTS 4,149,107 4/1979 Guenard ..... 315/3.6

*Primary Examiner*—Robert Segal
*Assistant Examiner*—Edward P. Westin
*Attorney, Agent, or Firm*—Roland Plottel

[57] ABSTRACT

The present invention relates to a backward wave mode oscillator tube, the delay line of which is in two sections of dissimilar length both operating in the backward wave mode, aligned in the direction of propagation of the electrons of the beam, the second being substantially shorter than the first and exhibiting a structure homothetic with the first in the ratio 1/n, n being an integer, with a load arranged at the end of this second section which is adjacent the electron-gun, in which load is picked-up electromagnetic energy on the $n^{th}$ harmonic of the predominant component of the wave in the first section.

3 Claims, 4 Drawing Figures

BACKWARD WAVE OSCILLATOR TUBE UTILIZING SUCCESSIVE DELAY LINE SECTIONS FOR INCREASED POWER

The present invention relates to a backward wave electronic oscillator tube for generating radio waves in the microwave range. The tube which forms the object of the present invention relates more particularly to the generation of waves in the millimetric and submillimetric wavebands.

In the following, some of the features of travelling wave tubes in general will be recapitulated. In these tubes, there is an interaction between an electron beam and a delay line of periodic structure arranged opposite the beam, along which delay line electromagnetic energy propagates. The interaction in question occurs between those components of the electromagnetic field which appear in the neighbourhood of the delay line, and the electron beam itself, when the phase velocity of these components is close to that of the electrons in the beam, and moreover in the same direction thereas.

In travelling wave tubes of forward wave or in other words progressive wave kind, propagation of the energy along the delay line also takes place in the same direction as the velocity of the electrons in the beam; in those of backward wave design, regressive wave tubes, by contrast it takes place in the opposite direction. However, among the aforementioned components there exists at least one whose phase velocity is negative, that is to say is directed in the opposite direction to the direction of propagation of the energy and thus the direction of propagation of the beam. Whereas in these latter tubes the energy propagates towards that end of the delay line where the beam enters the interaction space. One of these components has its phase velocity directed in the direction of the beam. If a component of this kind is the predominant component in the interaction in question, the tube is referred to as a backward wave tube and the power is picked off at that end of the tube which is opposite to the end at which the beam leaves the interaction space, that is to say at the end adjacent the cathode at which beam emanates. Both these kinds of tubes are well known from the prior art, the latter type in particular from U.K. No. 699 893 and 743 519, reference to which will be made as necessary.

Travelling wave tubes of backward wave design, that is to say regressive wave tubes, offer the advantage of having a very wide electronic tuning band, continuously variable by parameters upon which the electron velocity depends, that is to say the voltage on the delay line, if there is only an electric field and the magnetic field if, as in so-called cross-field tubes, these two kinds of fields are both applied to the beam.

However, the designs produced by the present Applicant has shown that the inherent attenuation of the delay lines used in the millimeter and sub-millimeter wavebands is often extremely high and may reach around 100 decibels overall. In particular in backward wave tubes, this is translated into terms of an output power, picked off across the external load coupled to the delay line at a point located close to the cathode system of the tube, which, under the best conditions of adjustment, is very much lower than that expected accordance with the theoretical predictions made upon the hypothesis of a loss-free line; we shall return to this point later on in the description.

To overcome this drawback, it has been necessary to increase the length of the line in order to increase the interaction length between beam and line. At the same time, however, the total losses in the delay lines are increased as a consequence so that ultimately no appreciable improvement is reached.

After analysing this difficulty, applicant has arrived at a travelling wave tube structure in accordance with the invention, operating in the backward wave mode, in which this power loss is substantially limited. The structure in accordance with the present invention makes it possible, other things being equal, to achieve a substantial increase in the output level from travelling wave tubes of backward wave design in relation to the prior art tubes of the same kind.

Reference is made to applicant's U.S. Pat. No. 4,149,107, assigned to the same assignee as the present application, the teaching of which is incorporated by reference into the present application.

Now, certain applications require wide-band radiowave generators capable of operating in the ultra-high frequency range on wavelengths of a fraction of a millimeter and having a high power level of the order of a few tens of milliwatts. In the prior art, these levels barely exceed one milliwatt on wavelengths of this order.

Two successive delay lines sections placed along the path of the beam enable the power generated in a backward mode oscillator tube to be increased.

According to the present invention, the operating frequency of the first line section, or basic frequency, which is the frequency of the preponderant component of this line section, is subjected to multiplication.

The invention will be better understood from a consideration of the ensuing description and the attached figures where similar references designate similar elements and which represent:

FIGS. 1 to 4 show four diagrammatic views of the multiplier according to the present invention.

Figure 1:
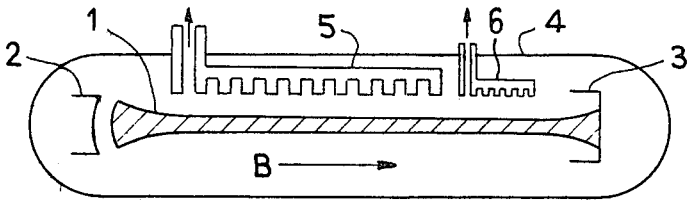
FIG. 1–4 are various examples of embodiments of backward wave oscillator tube according to the present invention also referred to hereinafter as frequency multiplier tube.

In all these Figures, the reference 1 denotes the electron beam (hatched area) travelling between the cathode 2, by which it is produced, and the collector 3 by which it is collected at the other end of the tube. None of the additional components normally associated with the cathode 2 for forming the gun of the tube under the usual conditions has been shown. The reference 4 denotes the vacuum envelope of the tube while the reference B denotes a magnetic induction by which the electron beam is guided along its path inside the envelope 4.

In every case, the reference 5 denotes the first periodic delay line of the frequency multiplier tube according to the present invention. Like the other delay lines of the tube, this line is diagrammatically represented by an indented rectangle. In the examples shown in the Figures, they are comb structures of a standard type. The dimensions of the teeth of these combs are generally fractions of the operating wavelength of the line. In the Figures, the vertical arrows represent waves entering the tube or leaving it through the coupling elements (no reference) in which they are placed. In these Figures, the sources supplying the voltages applied to the various electrodes (cathode, line, collector, etc.) have not been shown, as pertaining to prior art technique.

FIG. 1 shows a first example of the frequency multiplier according to the present invention. In this Figure, the reference 6 denotes a second delay line section of the frequency multiplier placed after the first section on the path followed by the beam. It operates on a harmonic of the wave generated in the first line section 5, namely the 2nd harmonic of 0.5 mm wavelength corresponding to the basic frequency of the line 5 of 300 GHz. This high-frequency energy is collected on leaving the second line section at its end nearest the gun. As can be seen from the Figure, a high-frequency energy is also collected at one of the ends of the first line section 5 which, at the basic frequency, shows losses which are sufficiently limited for a high-frequency energy to be generated by interaction of the beam with this first line section.

According to the invention, the two line sections 5 and 6 are advantageously in the form of two periodic structures homothetic with one another in the ratio of the operating frequencies, i.e. the basic frequency and the frequency of the harmonic. More exactly, the homothetic ratio by which it is possible to pass from the first line section to the second line section is 1/n, where n is the order of the harmonic in question. In operation, the two line sections are brought to the same voltage in relation to the reference voltage (cathode). In order to obtain the maximum level on the harmonic, it is also possible to apply different voltages to the two lines 5 and 6.

Figure 2:
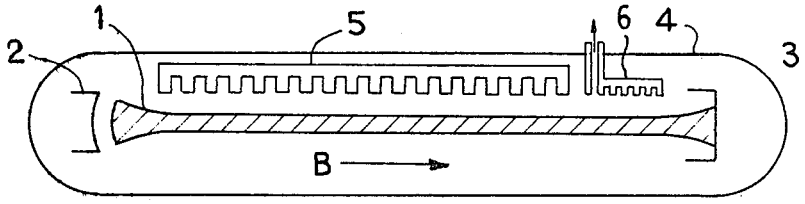

FIG. 2 shows an example similar to the preceding example, except that the losses of the line section 5 are such that no energy can be collected on the line 5.

Figure 3:
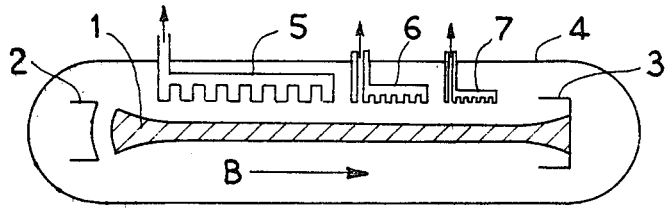

FIG. 3 shows an example of embodiment in which two harmonics of the basic frequency of the line section 5 are obtained on two other line sections placed along the path of the beam, the preceding line section 6 and a line section 7 operating on the third harmonic of the basic frequency corresponding to a wavelength of approcimately 0.3 mm in the example given above. In this case, too, the last two lines 6 and 7 are if necessary brought to the same operating voltage as the line 5.

According to the invention, other line sections may be added along the path of the beam for producing high-frequency energy on other harmonics of the basic frequency of the line sections 5.

Figure 4:
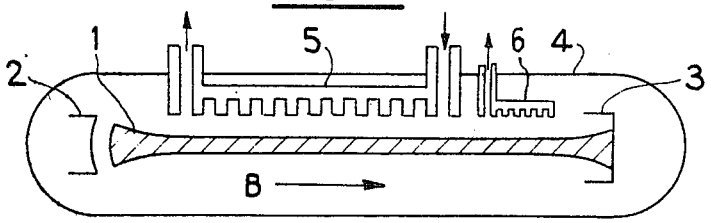

Finally, in another example shown in FIG. 4, the oscillation of the first line section 5 is based on a frequency generated by an external generator of which the high-frequency energy is injected into the line at its end remote from the cathode (central vertical arrow). The tube operates as a true frequency multiplier on the basis of the control frequency.

For the above-mentioned application to infra-red spectrometry, the ultra-high-frequency energy generated in the multipliers is mixed with the incident infra-red radiation.

I claim:

1. A backward wave oscillator which comprises:

a source of a beam of electrons;

means for focusing said beam of electrons;

a collector spaced from said source for receiving said beam of electrons; and a delay line exhibiting an attenuation factor per unit length, disposed intermediate said collector and said electron beam source, along which delay line an electromagnetic wave propagates in operation and interacts with the beam, characterized in that: said delay line comprises a first and a second delay line section;

said first delay line section modulating the electron beam as it passes thereunder and having a length such that due to its attenuation factor per unit length substantially no energy is available at the end thereof closest to said electron beam source as a result of said interaction, the only result of said interaction being a modulation of the electron beam;

said second delay line section substantially shorter than said first delay line section being incapable of sustaining oscillations in the absence of the priorly modulated electron beam, the length of said second delay line section being such that due to its attenuation factor per unit length oscillations under interaction with the electron beam priorly modulated by the first delay line section are generated, said second delay line section having a structure homothetic with the first in the ratio 1/n, where n is an integer, said backward wave oscillator further comprising;

means, coupled to said second delay line section, for extracting oscillatory energy from the backward wave oscillator, the oscillator supplying in that means an electromagnetic energy on the $n^{th}$ harmonic of the frequency of the predominant component of the wave in the first line section.

2. A backward-wave oscillator tube according to claim 1 wherein the velocity of electron beam is uniform over the entire length of its trajectory from source to collector, and said energy extracting means is coupled to the end of said second delay line section which is closest to said beam source.

3. A backward-wave oscillator tube as claimed in claim 1 or 2 above, characterised in that it additionally comprises other lines homothetic in structure with the first line section following the second line section along the path of the beam, and in that it comprises means for coupling charges at the ends of these lines nearest said cathode, said tube supplying in these charges electromagnetic energy on harmonics of the predominant component.

* * * * *